United States Patent [19]

Koenig et al.

[11] 4,422,564

[45] Dec. 27, 1983

[54] NEEDLE THREADING DEVICE

[76] Inventors: Herbert G. Koenig; Margaret E. Koenig, both of 807 Grossman Ave., Rhinelander, Wis. 54501

[21] Appl. No.: 198,305

[22] Filed: Oct. 20, 1980

[51] Int. Cl.[3] ..... D05B 87/00

[52] U.S. Cl. ..... 223/99

[58] Field of Search ..... 223/99; 81/43

[56] References Cited

U.S. PATENT DOCUMENTS

| | | | |
|---|---|---|---|
| 1,188,270 | 6/1916 | Hanson | 81/43 |
| 1,288,322 | 12/1918 | Webb | 223/99 |
| 1,504,917 | 8/1924 | Trzeciak | 223/99 |
| 1,661,701 | 3/1928 | Michler | 81/43 X |
| 2,167,080 | 7/1939 | Mason | 223/99 |
| 2,448,432 | 8/1948 | Huning | 223/99 |
| 2,575,652 | 11/1951 | Bovee | 81/43 |
| 3,893,602 | 7/1975 | Ivy | 223/99 |

FOREIGN PATENT DOCUMENTS

| | | | |
|---|---|---|---|
| 168348 | 11/1950 | Austria | 223/99 |

OTHER PUBLICATIONS

"Superior" Sewing Machine and Supply Corp., 48 W. 25th St., N.Y., N.Y., 1967, p. 343.

*Primary Examiner*—Louis Rimrodt
*Attorney, Agent, or Firm*—Gregory J. Nelson

[57] ABSTRACT

A needle threading device consisting of a pair of thin, substantially rigid blades joined at one end and spaced apart in a normal position at the other. The blades at the open end are insertable through the eye of a needle to receive the thread or yarn and can then be "pinced" and held together with one hand and the yarn pulled through the needle as the device is withdrawn and the needle is held. In other embodiments the device consists of a pair of oppositely extending blades of different widths for various sewing or needlecraft operations. In still another embodiment, a plurality of pairs of blades of different sizes are pivotally joined to a shaft and the desired blade can be pivoted to a position of use.

3 Claims, 5 Drawing Figures

NEEDLE THREADING DEVICE

The present invention relates to a sewing accessory and more particularly relates to a device to assist in manually threading the eye of an embroidery or sewing needle.

In various types of sewing and needlecrafting including embroidery, crewel, needlepoint and the like, it is necessary for the individual to thread the eye of the needle by inserting the thread or yarn through the eye. This is often accomplished by twisting the yarn or thread to form a point and then holding the thread or yearn in one hand the needle in the other and attempting to align the eye with the thread to insert the thread or yarn through the eye. Since the eye of a needle is usually quite small, this is a difficult task often complicated by the fact that the end of the yarn or thread may be frayed or will bend causing the yarn to be deflected away from the eye of the needle. If the person attempting this procedure has a physical infirmity or has impaired vision, the procedure can be frustrating, difficult and in some cases, beyond the capability of that person. Thus, many individuals have difficulty engaging in sewing and needlecraft activities.

Various techniques and apparatus have been developed to assist the tailor or seamstress in threading a needle. One of the simplest techniques is called the wrap method. In this method the needle is held between the thumb and forefinger and the thread or yarn is wrapped about the needle and creased by pulling it taut about the needle. The needle is removed and while holding the creased ends of the yarn firmly between the fingers, the eye of the needle is pressed over the creased yarn and pulled through.

Other methods involve the use of mechanical aids in the threading operation. A strip of paper approximately two inches long and one-quarter inch wide can be cut and folded in half. The yarn is placed inside the folded paper and the paper inserted through the eye of the needle. The former method has a disadvantage in that the individual must still align the eye of the needle with a rather small crease in the yarn which is visually and tactilely difficult for many people. The latter paper method represents an improvement but still presents difficulty as the paper is flexible and sufficient pinching pressure must be applied to hold the yarn in place which is difficult for an infirmed individual.

Another device to assist the individual in threading a needle consists of a small flexible wire loop secured to a tab-like handle. The thread is inserted in the loop and the loop, in turn, is inserted through the eye of the needle. Use of a device of this type still requires that the individual insert a doubled-over section of the thread or yarn into the confines of the small loop. Further, the double strand is often bulky and difficult to draw through the needle eye, a procedure which may result in the strand becoming worn or damaged.

Accordingly, there exists a need for an improved device to assist the person engaged in sewing and needlecraft in threading the needle. Briefly, in accordance with the present invention, a needle threading device is provided which consists of a pair of thin, relatively stiff pincer blades secured at one end. In the normal position, the blades have a position with their distal ends slightly spaced apart so that the yarn or thread can be inserted therebetween. Once the yarn or thread is inserted, the blades can be "pinced" together and a single strand of the thread or yarn drawn through the eye of the needle. In other embodiments of the present invention, the device can be provided with a pair of oppositely extending blades, one pair being a smaller size than the other pair, to conveniently accomodate larger or smaller needle eyes depending on the type of sewing or needlecraft to be done.

Still another embodiment of the present invention provides a plurality of pairs of blades commonly and pivotally mounted about a single shaft so that the desired pair of blades can be rotated to a use-position.

Briefly, the above and other objects and advantages of the present invention will become more apparent from the following specification, claims and drawings in which:

Figure 1A:
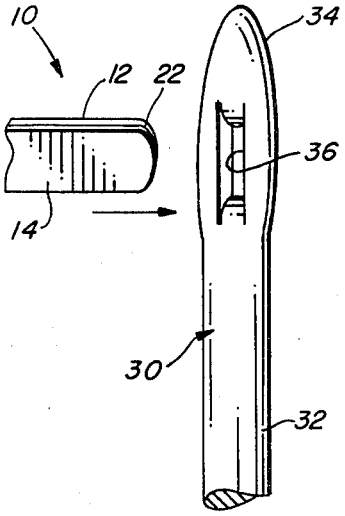
FIGS. 1A, 1B and 1C illustrate the use of the needle threader of the present invention.
Figure 1B:
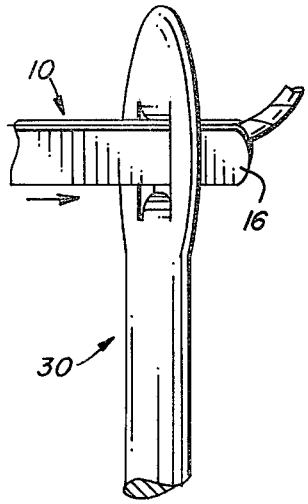
Figure 1C:
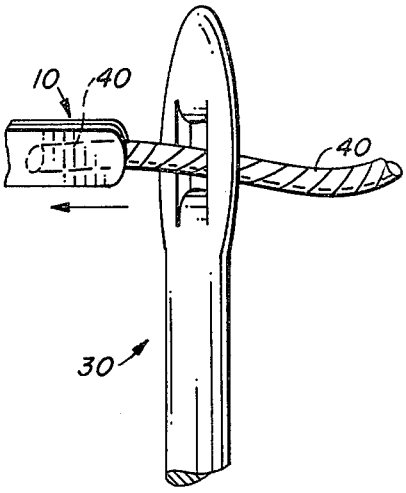
Figure 2:
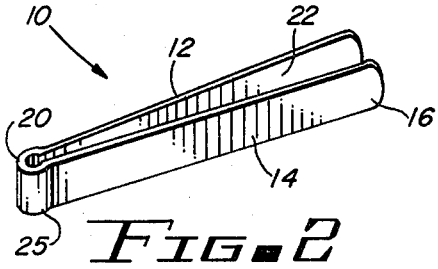
FIG. 2 is a perspective view of a preferred embodiment of the needle threading device of the present invention.

Turning now to the drawings, particularly FIG. 2, the needle threading device of the present invention is generally designated by the numeral 10 and includes a pair of pincer blades 12 and 14. Blades 12 and 14 each have a distal end 16, joined at their opposite ends at bight section 20. Preferably the blades 12 and 14 are relatively thin and are rigid, formed of a suitable material such as a spring steel. Blades may be formed by stamping from a single piece of stock material and bent to the configuration shown in FIG. 2. In the normal, that is nonactuated position, the blades 12 and 14 are slightly spaced apart defining an opening 22. It may be desirable in forming the device to impose a slight transverse crimp near the bight area 20 indicated by the numeral 25 to maintain the blades in a separated, open position. The thickness or guage of the material of the blades is selected to allow the blades to be inserted with yarn or thread therebetween and to provide sufficient clearance with the width of the eye of a conventional needle. Similarly, the transverse width of blades 12 and 14 is selected to be freely insertable in the eye of a conventional needle as shown in FIGS. 1A to 1C.

The present invention will be more fully understood from the following description of use. Referring to FIGS. 1A, 1B and 1C, the needle threading device 10 is shown in conjunction with conventional needle 30 having a shank 32 and end 34 and an elongate eye 36. Depending upon the type of needle, the eye may be variously positioned. For example, needles for use with sewing machines often have the eye disposed adjacent the point. Similarly, the needle and eye may be of various sizes depending on the type of sewing or needlecraft operation to be performed.

The needle threading device 10 is manually held by the user at a location near the proximal end 20. The distal end of blades 12 and 14 are inserted through the eye 36 of the needle as best seen in FIG. 1B. Since an opening or gap 22 is defined between the blades 12 and 14, the end 42 of a single strand of thread or yarn 40 can be inserted between the blades 12 and 14 as shown in FIG. 1B. The end 16 of the threader is held with one hand and the needle moved toward the end as seen in FIG. 1B. The end 16 is released and the user then applies a slight closing force, as for example, with the thumb and forefinger bringing the blades 12 and 14 into close contact pincing the end 42 of yarn 40 between the blades. The needle threading device 10 and end 42 of yarn or thread 40 can be withdrawn as illustrated in FIG. 1C. The closing force on the blades is released and the needle threading procedure is completed. The relative stiffness of blades 12 and 14 permit the closing force to be applied easily without the user having to "squeeze" with excessive force. The required stiffness or rigidity of the blades should be such that the blades will firmly secure the thread without excessive bending or flex.

The device of the present invention is particularly advantageous to persons with physical disabilities such as arthritis and for beginners in needlecraft and for individuals with visual impairment.

Figure 5:
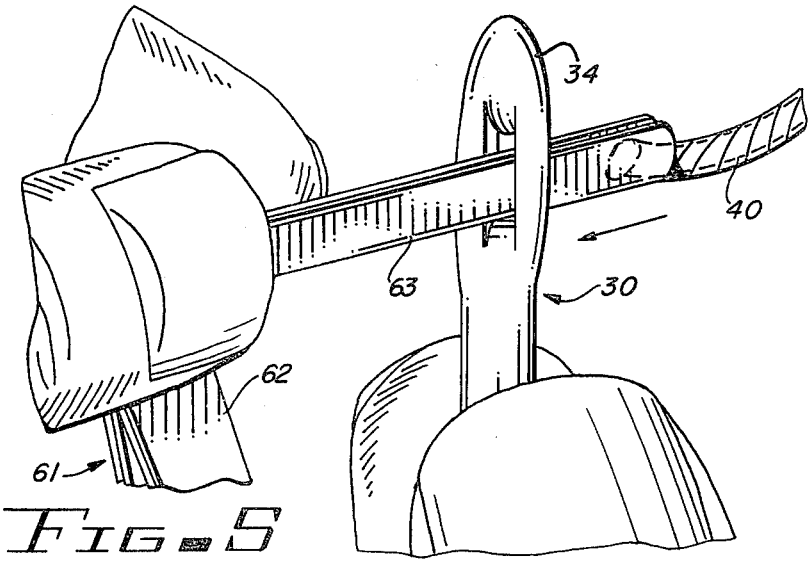
FIG. 5 illustrates use of the embodiment shown in FIG. 3.

FIG. 5 illustrates an alternate embodiment of the present invention generally designated by the numeral 50. Embodiment 50 is especially adapted for threading needles of several sizes. A pair of blades 51 and 52 are provided and blades 53 and 54 oppositely extend from blades 51 and 52. Blades 53 and 54 are narrower in transverse width. The opposite blades are joined at intermediate section 56 by mechanical fastener 57, shown as a rivet or bolt extending through the blades. Thus, for threading larger needles with larger eyes, such as those typically used in needlepoint, blades 51 and 52 would be used as it will be somewhat easier to manipulate. For finer operations using smaller needles with smaller eyes, blades 53 and 54 can be used as they will be insertable through the eye of the needle.

Figure 4:
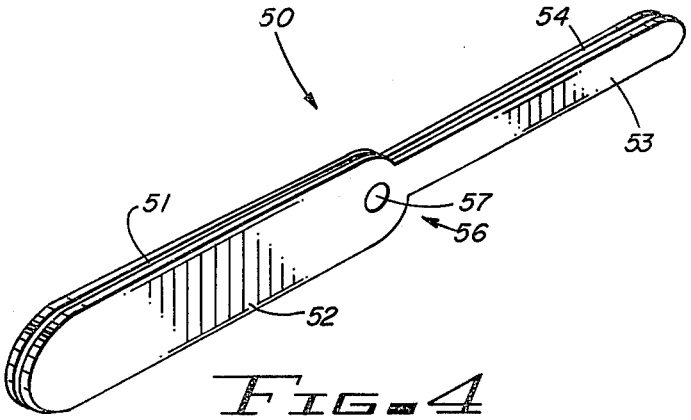
FIG. 4 is a perspective view of another embodiment of the needle threading device of the present invention.
Figure 3:
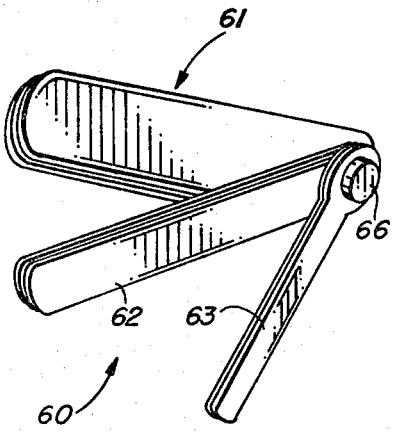
FIG. 3 is a perspective view illustrating an alternate embodiment of the threading device of the present invention.

FIG. 4 shows still another embodiment of the present invention in which a plurality of pairs of blades are shown. This embodiment is generally designated by the numeral 60 and has a first pair of blades 61, and additional pairs 62 and 63 of progressively increasing blade width. Blade pair 61 and 62 and 63 are all pivotally joined at the proximal end to rivet 66. When it is desired to thread a needle, the appropriate pair of blades can be selected and pivoted to a position of use as shown in FIG. 6. When the needle threader of embodiment 60 is not in use, all of the blades can be folded in juxtaposition for convenience of storage.

Thus, it will be seen from the foregoing that the present invention provides a needle threading device which is simple, efficient and will be substantial aid to the person involved in sewing or needlecraft operations. The needle threader can be used for a substantial number of operations including manual or machine sewing, embroidering, crewel and needlepoint. One particular advantage of the present invention is apparent when embroidering on a frame when it is necessary to fasten-off an end 2 or 2½ inches long or when the needle slips off the yarn or thread. Generally in this situation, one has to lift the frame to eye level and attempt to re-thread the needle while supporting the frame. With the present threader, the user can easily grasp or support the frame and by "feel" thread the needle with facility.

The device of the present invention can be used with various yarns and threads. The device will be of particular benefit to those with a physical or visual impairment. The rigidity of the blade members allows the yarn to be easily pinced between the blades with the minimum of closing force required. Persons such as those suffering from arthritis will find the device particularly useful. The device may also have other application including surgical application in assisting medical personnel in inserting suture material into a needle.

It will be obvious to those skilled in the art to make various changes, modifications and alterations to the needle threading device of the present invention. To the extent that these changes, modifications and alterations do not depart from the spirit and scope of the appended claims, they are intended to be encompassed therein.

We claim:

1. A needle threading apparatus for inserting a thread in the eye of a needle, said apparatus comprising:

(a) a pair of substantially planar blades of substantially rigid material each having a distal end and a proximal end and being joined at their opposite proximal ends; and (b) said blades defining a space therebetween for reception of a section of thread and being substantially equal in length and being in a normally open position, said blades having a width and thickness so that at least the distal ends of the said blades are adapted to be inserted through the eye of a needle whereby thread can be inserted between the blades and the blades pinched together and the yarn drawn through the eye of the needle.

2. The apparatus of claim 1 wherein said apparatus comprises a plurality of pairs of blades commonly joined at their proximal ends.

3. The apparatus of claim 2 wherein said plurality of pairs of blades are pivotally connected whereby said pairs may be stored in juxtaposition and whereby a selected pair of blades may be rotated to a use-position.

* * * * *